US008210861B2

(12) United States Patent
Tanis et al.

(10) Patent No.: US 8,210,861 B2
(45) Date of Patent: Jul. 3, 2012

(54) CONNECTOR ASSEMBLY HAVING TWO CONNECTORS CAPABLE OF MOVEMENT IN DIFFERING DIRECTIONS

(75) Inventors: William E. Tanis, Harrisburg, PA (US); Brian J. Williams, York, PA (US); Paul Walter McDowell, Fisher, IN (US)

(73) Assignee: Tyco Electronics Corporation, Berwyn, PA (US)

( * ) Notice: Subject to any disclaimer, the term of this patent is extended or adjusted under 35 U.S.C. 154(b) by 237 days.

(21) Appl. No.: 12/778,822

(22) Filed: May 12, 2010

(65) Prior Publication Data

US 2011/0281451 A1 Nov. 17, 2011

(51) Int. Cl.
*H01R 13/64* (2006.01)

(52) U.S. Cl. ..... 439/248

(58) Field of Classification Search ..... 439/246–248
See application file for complete search history.

(56) References Cited

U.S. PATENT DOCUMENTS

| | | | | |
|---|---|---|---|---|
| 4,684,192 | A | 8/1987 | Long et al. | |
| 4,820,180 | A | 4/1989 | Mosquera et al. | |
| 4,824,387 | A | 4/1989 | deJong et al. | |
| 4,988,308 | A | 1/1991 | Toedtman | |
| 5,017,151 | A | 5/1991 | Peterson | |
| 5,167,520 | A | 12/1992 | Henry et al. | |
| 5,259,779 | A | 11/1993 | Ooya et al. | |
| 5,514,000 | A * | 5/1996 | Krause et al. | 439/248 |
| 5,516,303 | A * | 5/1996 | Yohn et al. | 439/248 |
| 5,575,673 | A | 11/1996 | Dahlem et al. | |
| 5,622,511 | A | 4/1997 | Jarrett | |
| 6,017,233 | A * | 1/2000 | Fry et al. | 439/248 |
| 6,030,242 | A | 2/2000 | Cunningham et al. | |
| 6,196,856 | B1 | 3/2001 | De Villeroche | |
| 6,364,536 | B1 * | 4/2002 | Chen et al. | 385/59 |
| 6,908,325 | B2 * | 6/2005 | Bernat et al. | 439/246 |
| 6,908,326 | B2 | 6/2005 | Shiota et al. | |
| 7,083,453 | B2 | 8/2006 | Herring et al. | |
| 7,090,521 | B2 | 8/2006 | Nishio et al. | |
| 7,186,126 | B2 | 3/2007 | Umehara et al. | |
| 7,204,707 | B2 | 4/2007 | Kawase et al. | |
| 7,381,071 | B2 | 6/2008 | Hayashi | |
| 7,404,726 | B1 | 7/2008 | Herring et al. | |
| 7,507,099 | B2 * | 3/2009 | Cowgill et al. | 439/248 |

FOREIGN PATENT DOCUMENTS

EP 0 717 470 6/1996

OTHER PUBLICATIONS

International Search Report, International Application No. PCT/US2011/000826, International Filing Date Nov. 5, 2011.

* cited by examiner

*Primary Examiner* — Vanessa Girardi

(57) ABSTRACT

A connector assembly including a first connector configured to be movably mounted to a support structure and having a first mating terminal. The first connector is movable with respect to the support structure in an axial direction along an alignment axis. The connector assembly also includes a second connector that is configured to be movably mounted to a support panel and has a second mating terminal. The second connector is movable with respect to the support panel in a radial direction relative to an alignment axis. The second connector shifts in the radial, direction to align the first and second mating terminals when the first and second connectors engage each other in a misaligned manner. The first connector moves between a projected position and a retracted position along the alignment axis to facilitate establishing a communication pathway between the first and second mating terminals.

20 Claims, 8 Drawing Sheets

CONNECTOR ASSEMBLY HAVING TWO CONNECTORS CAPABLE OF MOVEMENT IN DIFFERING DIRECTIONS

BACKGROUND OF THE INVENTION

The subject matter herein relates generally to connector assemblies, and more particularly, to connector assemblies configured to self-align connectors during a mating operation.

Connector assemblies may be used to establish communication pathways between electrical contacts or between optical fiber terminals. Exemplary connector assemblies include two separate connectors that may be sized, shaped, or otherwise configured to mate with one another to establish the communication pathway(s). In some operating environments, an individual attempting to mate the two connectors may be unable to view the two connectors as the connectors engage each other. In such "blind mating" situations, the technician risks damaging the two connectors if the two connectors engage each other in a misaligned manner.

Various connector assemblies have been proposed for tolerating misalignments between the connectors during a mating operation. Such connector assemblies may include a floatable connector that moves with respect to a panel and a mating connector that is configured to engage the floatable connector. When the mating connector engages the floatable connector, the floatable connector moves with respect to the panel to align the two connectors. However, such connector assemblies may have limited capabilities. For example, the connector assemblies typically include only one floatable or movable connector. Also, the floatable connectors may be limited to either side-to-side movement or vertical (up-down) movement. Furthermore, if the force applied to the mating connector is excessive, the floatable connector may be unable to adjust and at least one of the connectors may be damaged.

Thus, there is a need for connector assemblies capable of moving in various directions. There is also a need for connector assemblies that reduce the likelihood of damaging one or both connectors. In addition, there is a general need for improved connector assemblies, as compared to known connector assemblies, that are capable of tolerating misalignment during a mating operation.

BRIEF DESCRIPTION OF THE INVENTION

In one embodiment, a connector assembly is provided that is configured to facilitate aligning and engaging first and second mating terminals to establish a communication pathway. The connector assembly includes a first connector that is configured to be movably mounted to a support structure and has at least one first mating terminal. The first connector is movable with respect to the support structure in an axial direction along an alignment axis. The connector assembly also includes a second connector that is configured to be slidably mounted to a support panel and has at least one second mating terminal. The second connector is slidable along the support panel in a radial direction with respect to the alignment axis. The second connector shifts in the radial direction to align the first and second mating terminals when the first and second connectors engage each other in a misaligned manner. The first connector moves between a projected position and a retracted position along the alignment axis to facilitate establishing a communication pathway between the first and second mating terminals.

In another embodiment, a connector system is provided that includes a modular component having a support structure with a front surface. The modular component also includes a first connector that is configured to be movably mounted to the support structure. The first connector is movable toward and away from the first surface of the support structure in an axial direction. The connector system also includes a base component that has a support panel with a front surface. The base component also includes a second connector that is configured to be movably mounted to the support panel. The second connector is movable along the support panel in a radial direction that is parallel to the front surface of the support panel. The modular and base components are configured to removably engage each other through a mating operation. The second connector shifts in the radial direction during the mating operation when the first and second connectors are misaligned by a radial distance. The first connector moves in the axial direction during the mating operation.

DETAILED DESCRIPTION OF THE INVENTION

Figure 2:
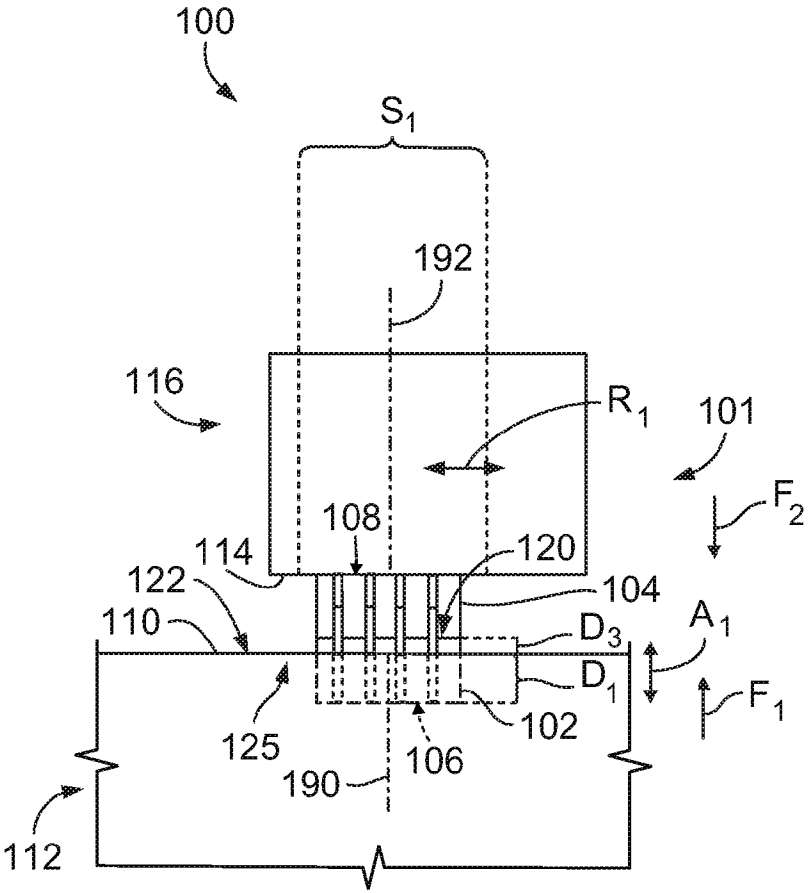
FIG. 2 is a schematic view of the connector system shown in FIG. 1 in which the two connectors are in a communicatively engaged state.
Figure 1:
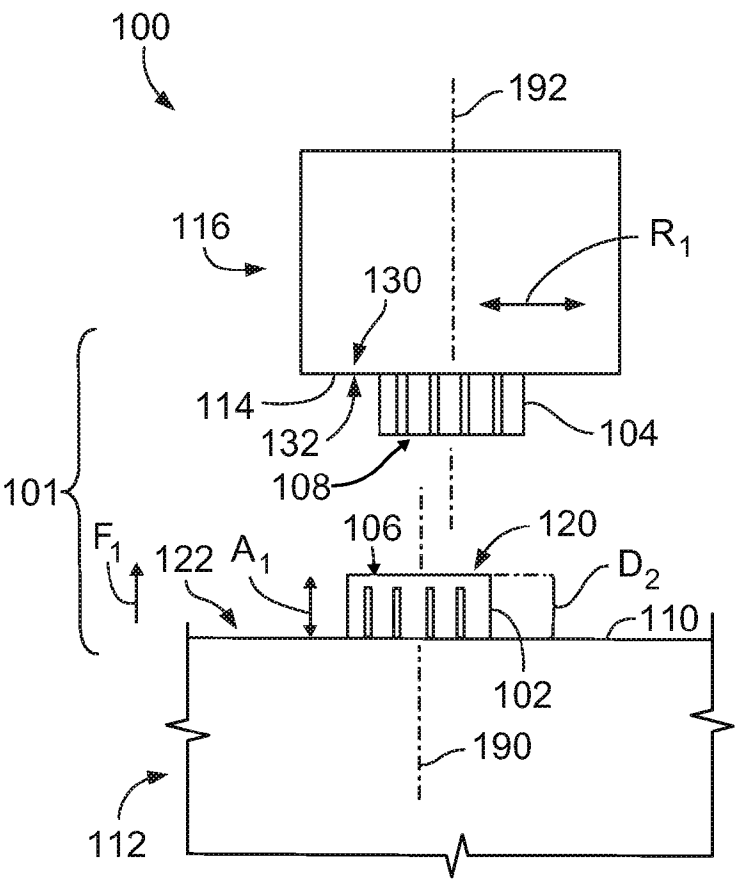
FIG. 1 is a schematic view of a connector system having a connector assembly formed in accordance with one embodiment that includes two connectors separated from each other in a disengaged state.

FIGS. 1 and 2 are schematic illustrations of a connector system 100 that includes a connector assembly 101 formed in accordance with one embodiment. The connector assembly 101 includes first and second connectors 102 and 104. FIG. 1 shows the first and second connectors 102 and 104 in a disengaged state or positional relationship, and FIG. 2 shows the first and second connectors in a communicatively engaged state or positional relationship. The first and second connectors 102 and 104 include first and second mating terminals 106 and 108, respectively, that are configured to communicatively couple to each other to establish at least one of an electrical and an optical connection. The mating terminals 106 and 108 may be housed or enclosed within the first and second connectors 102 and 104 or the mating terminals 106 and 108 may project therefrom into surrounding space. The mating terminals may include socket contacts and mating pins in which the socket contacts are configured to receive the mating pins to establish an electrical connection where current flows therethrough. Alternatively or additionally, the mating terminals may include optical terminals that are configured to engage each other to establish an optical connection. However, embodiments described herein are not limited to certain types of terminals, but may be used with various types.

In the disengaged state shown in FIG. 1, the first and second mating terminals 106 and 108 are separated and spaced apart from each other. In the communicatively engaged state shown in FIG. 2, the first and second mating terminals 106 and 108 are physically connected to each other and have established at least one of an electrical and optical connection. Also shown in FIGS. 1 and 2, the first connector 102 may be coupled to a support structure 110 of a first component 112, and the second connector 104 may be coupled to a support structure 114 of a second component 116. The support structures 110 and 114 may be, for example, support walls or panels of the corresponding components. In the illustrated embodiment, the first component 112 may be a base or support component that remains in a fixed position during a mating operation. The second component 116 may be a modular component that is configured to be moved toward and removably couple to the first component 112 through the first and second connectors 102 and 104. Embodiments described herein may tolerate misalignment between the first and second components 112 and 116 during a mating operation. In particular embodiments, the second component 116 is moved by an individual to mate with the first component 112 in a manner in which the individual is unable to view the mating operation of the first and second components 112 and 116. However, embodiments described herein are not limited to use in such "blind-mating" operations.

As shown, the first connector 102 is oriented with respect to an alignment axis 190 and is movably mounted to the support structure 110. In the illustrated embodiment, the first connector 102 is configured to move in an axial direction $A_1$ (indicated by the double arrows) along the alignment axis 190 between a projected position (shown in FIG. 1) and a retracted position (shown in FIG. 2). The first connector 102 may move an axial distance $D_1$ (FIG. 2) between the projected and retracted positions.

In the illustrated embodiment, when the first connector 102 moves from the projected position to the retracted position, the first connector 102 may move through the support structure 110 and into the first component 112. For example, a forward-facing end 120 of the first connector 102 may be located a projected distance $D_2$ (FIG. 1) away from a front or exterior surface 122 of the support structure 110 when the first connector 102 is in the projected position. The forward-facing end 120 may be located a projected distance $D_3$ (FIG. 2) away from the exterior surface 122 in the retracted position. The projected distance $D_2$ may be greater than the projected distance $D_3$ and the difference between the projected distances $D_1$ and $D_3$ may be substantially equal to the axial distance $D_1$. In particular embodiments, the first connector 102 may be biased in the projected position. For example, a resilient force $F_1$ that is directed away from the support structure 110 may hold the first connector 102 in the projected position when the first and second connectors 102 and 104 are in the disengaged gate. The resilient force $F_1$ may resist movement of the first connector 102 in the axial direction toward the support structure 110 and also facilitate communicatively engaging the first and second connectors 102 and 104 through an interference fit.

Also shown, the second connector 104 is oriented with respect to a longitudinal axis 192 and is slidably mounted to the support structure 114. The second connector 104 may be slidable along the support structure 114 in a radial direction $R_1$ with respect to the longitudinal axis 192 and the alignment axis 190. The radial direction $R_1$ may be perpendicular to the axial direction $A_1$. In some embodiments, the second connector 104 is slidable along interior and exterior (or front) surfaces 130 and 132 of the support structure 114. The second connector 104 may be freely held by the support structure 110 such that the second connector 104 is floatable within a confined spatial region $S_1$ (FIG. 2) when one or more external forces are applied to the second connector 104. In some embodiments, the second connector 104 may resist radial movement through frictional forces between at least one of the interior and exterior surfaces 130 and 132 and the second connector 104.

During a mating operation, the first and second connectors 102 and 104 are oriented to face one another. The first and second connectors 102 and 104 may be moved toward each other such that at least one of the first and second connectors 102 and 104 is moved toward the other connector along an axial path. During some mating operations, the first and second connectors 102 and 104 may approach each other in a misaligned manner such that the mating terminals 106 and 108 would not communicatively engage each other if the first and second connectors 102 and 104 continued to move along the axial path(s). In some conventional or known connector assemblies, the mating terminals may be damaged if not properly aligned. However, in the embodiments described herein, the first and second connectors 102 and 104 may cooperate with each other to align and engage the mating terminals 106 and 108. For example, when the first and second connectors 102 and 104 engage each other, the first connector 102 may be shaped to redirect the second connector 104 so that the second connector 104 moves in the radial direction $R_1$ thereby aligning the mating terminals 106 and 108. When the first and second connectors 102 and 104 are aligned with each other, the corresponding mating terminals 106 and 108 are aligned with each other and the longitudinal and alignment axes 192 and 190 are also aligned or coincide with each other.

After the mating terminals 106 and 108 are aligned or while aligning the first and second mating terminals 106 and 108, the first connector 102 may move in the axial direction $A_1$ to facilitate communicatively coupling the first and second mating terminals 106 and 108. A mating force $F_2$ (FIG. 2) may be applied to the first connector 102 in a direction along the alignment axis 190 when the second connector 104 engages the first connector 102. If the mating force $F_2$ is greater than the resilient force $F_1$, the first connector 102 may move in the axial direction toward the retracted position. After the first and second connectors 102 and 104 are operatively engaged as shown in FIG. 2, the first connector 102 may be at least partially retracted with respect to the projected position (FIG. 1) or the first connector 102 may return to the projected position after the mating force $F_2$ is withdrawn. Accordingly, the connector assembly 101 may be configured to facilitate aligning and engaging first and second mating terminals 106 and 108 to establish a communication pathway 125 (FIG. 2). Moreover, the first and second connectors 102 and 104 may cooperate with each other to accommodate misalignment in three dimensions.

In the connector assembly 101, the second connector 104 is described as being movable in the radial direction $R_1$ and the first connector 102 is described as being movable in the axial direction $A_1$. However, in alternative embodiments, the first connector 102 may be part of a base or support component as described above, but may be movable in the radial direction, and the second connector 104 may be part of a modular component as described above, but may be movable in the axial direction.

Figure 3:
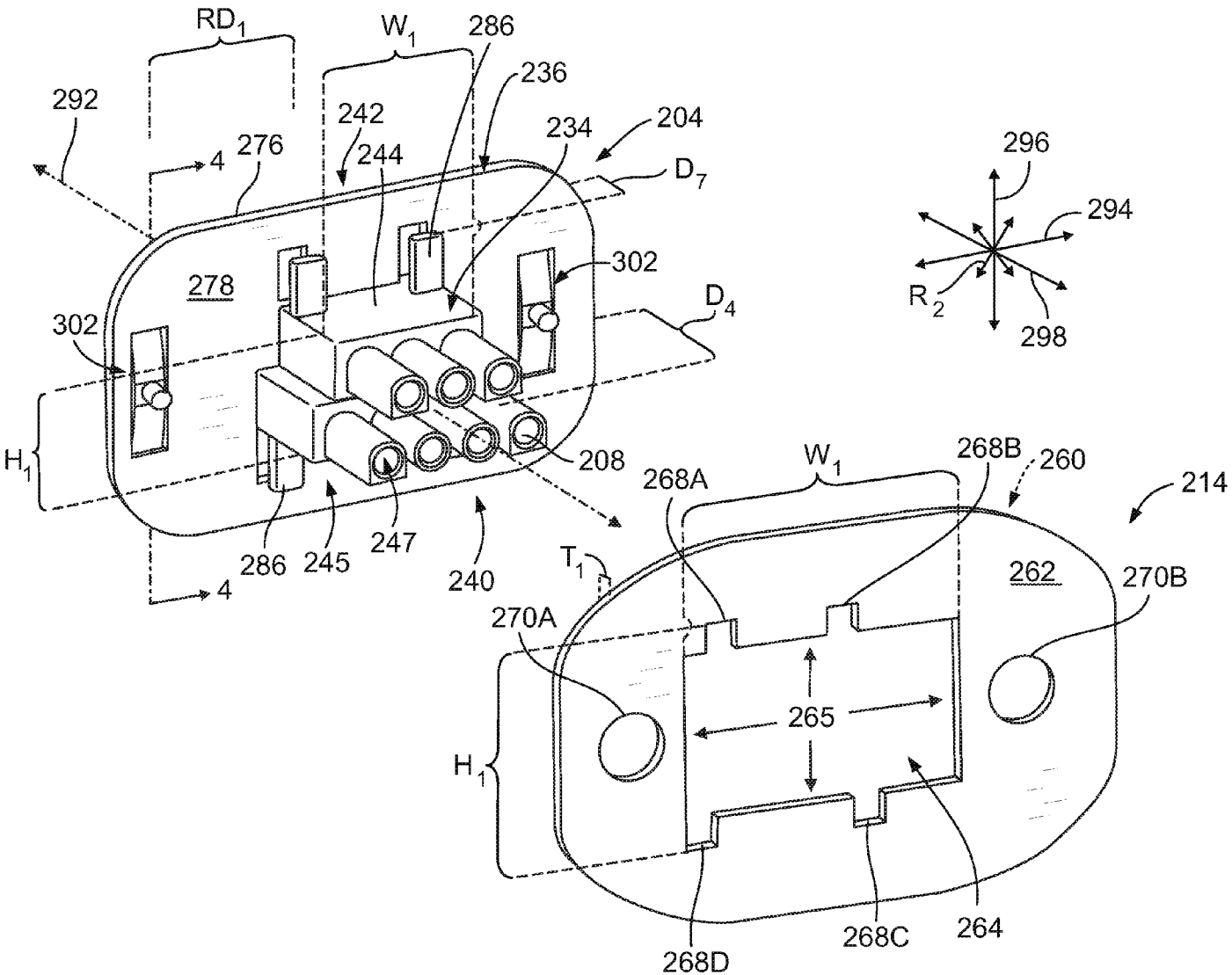
FIG. 3 is perspective view of a support structure and a mating connector formed in accordance with one embodiment that is configured to be slidably mounted to the support structure.

FIG. 3 is perspective view of a second or mating connector 204 and a support panel 214, which may have similar features as the second connector 104 (FIG. 1) and the support structure 114 (FIG. 1). As shown, the second connector 204 and the support panel 214 are oriented with respect to mutually perpendicular orientation axes 294, 296, and 298 (referenced herein as the lateral axis 294, the vertical axis 296, and the longitudinal axis 298). The second connector 204 is configured to be slidably mounted to the support panel 214 and movable in a radial direction $R_2$. For example, the radial direction $R_2$ may include any movement along a radial plane formed by the lateral and vertical axes 294 and 296, including rotational movement about a longitudinal axis 292, which is parallel to the longitudinal axis 298.

In the illustrated embodiment, the support panel 214 is a panel or wall having interior surface 260 and an exterior (or front) surface 262 and a thickness $T_1$ extending therebetween. The thickness $T_1$ may be measured along the longitudinal axis 298. The exterior surface 262 may face the first connector 402 (shown in FIG. 9). As shown, the support panel 214 includes a mounting window 264 that is sized and shaped to receive the second connector 204. The mounting window 264 is defined by a plurality of edges that are shaped to define a main portion 265 and a plurality of cut-out portions 268 that extend away from the main portion 265. In alternative embodiments, the mounting window 264 is not completely circumscribed by edges. The mounting window 264 has a height $H_1$ and a width $W_1$. Also shown, the support panel 214 may also include one or more displacement openings 270. In the illustrated embodiment, the support panel 214 includes a pair of displacement openings 270A and 270B that are positioned on opposite sides of the mounting window 264. The displacement openings 270A and 270B may be sized and shaped as desired to control a range of radial movement (or floatability) of the second connector 204 as will be described in greater detail below. The displacement openings 270A and 270B may also facilitate defining a confined spatial region that the second connector 204 is movable within.

Also shown in FIG. 3, the second connector 204 includes a forward-facing mating end 240 and a loading end 242 and a central longitudinal axis 292 extending therebetween. The loading end 242 is configured to engage electrical and/or optical cables or conductors, and the mating end 240 is configured to engage the first connector 402 (shown in FIG. 9). The second connector 204 includes a header portion 234 and a flange portion 236. The header and flange portions 234 and 236 may be integrally formed such that, for example, the header and flange portions 234 and 236 are molded from a common material and form a single part. In alternative embodiments, the header and flange portions 234 and 236 may be separate parts that are affixed to one another.

The header portion 234 is configured to hold mating terminals (not shown), such as the mating terminals 108 (FIG. 1), and pass through the mounting window 264 of the support panel 214. In some embodiments, the header portion 234 may be that portion of the second connector 204 that projects through the support panel 214 and is located in an exterior space with respect to the support panel 214. The header portion 234 includes a header body 244 that may be sized and shape to pass through the mounting window 264 and a plurality of terminal projections 245 that extend to corresponding distal ends that are an axial distance $D_4$ away from the flange portion 236. The axial distance $D_4$ may be measured along the longitudinal axis 292. The header portion 234 also has a width $W_1$ measured along a lateral axis 294 and a height $H_1$ measured along a vertical axis 296. The width $W_1$ and the height $H_1$ may extend in a radial manner away from the longitudinal axis 292. Also shown, each terminal projection 245 may include a corresponding cavity 247 where a mating terminal is located. However, in alternative embodiments, there may be no terminal projections that extend from the header body 244 and the header body 244 may be shaped to include the cavities 247.

Also shown in FIG. 3, the flange portion 236 may comprise a sidewall or panel body 276 that at least partially surrounds the header portion 234 about the longitudinal axis 292. The flange portion 236 may extend in a radial manner from the header portion 234. The panel body 276 may have a loading side 277 and a mating side 278 that face in opposite directions. The mating side 278 is configured to interface with the interior surface 260 of the support panel 214. Also shown, the flange portion 236 may include one or more float-control members 302. The float-control member 302 may be spaced apart from the header portion 234 a radial distance $RD_1$. The float-control members 302 are configured to engage the support panel 214 and interact with the displacement openings 270 to, permit the radial movement of the mating connector 204. In the illustrated embodiment, the flange portion 236 includes a pair of float-control members 302 that are on opposite sides of the header portion 234.

Also shown in FIG. 3, the second connector 204 may include one or more retaining tabs 286 that are sized and shaped to pass through corresponding cut-out portions 268 of the support panel 214. The retaining tabs 286 are configured to have a fixed position with respect to the mating side 278 and are spaced apart from the mating side 278 by an axial distance $D_7$. In the illustrated embodiment, the axial distance $D_7$ is approximately equal for each retaining tab 286. However, in alternative embodiments, the axial distances for each retaining tab 286 may be different. Furthermore, in the illustrated embodiment, the retaining tabs 286 are coupled to and extend away from the header body 244. However, in alternative embodiments, the retaining tabs 286 may extend directly from the mating side 278 or other features of the second connector 204 and have a fixed position relative to the mating side 278.

Figure 5:
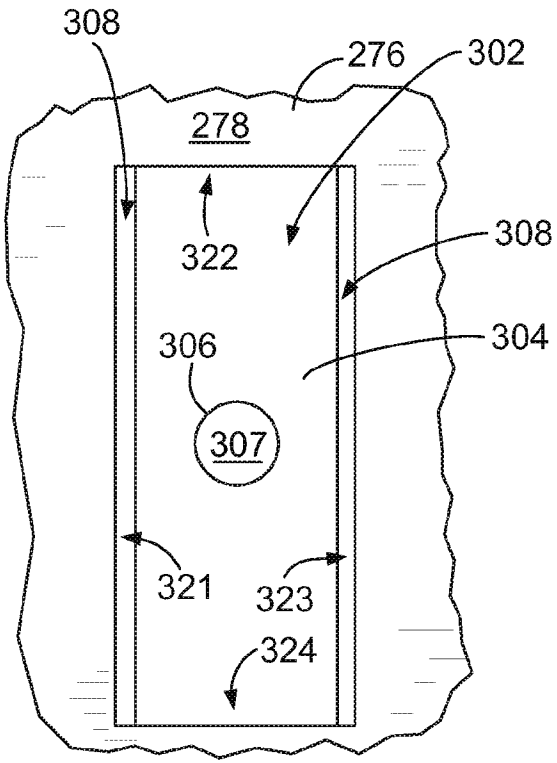
FIG. 5 is an enlarged plan view of the float-control member shown in FIG. 4.
Figure 4:
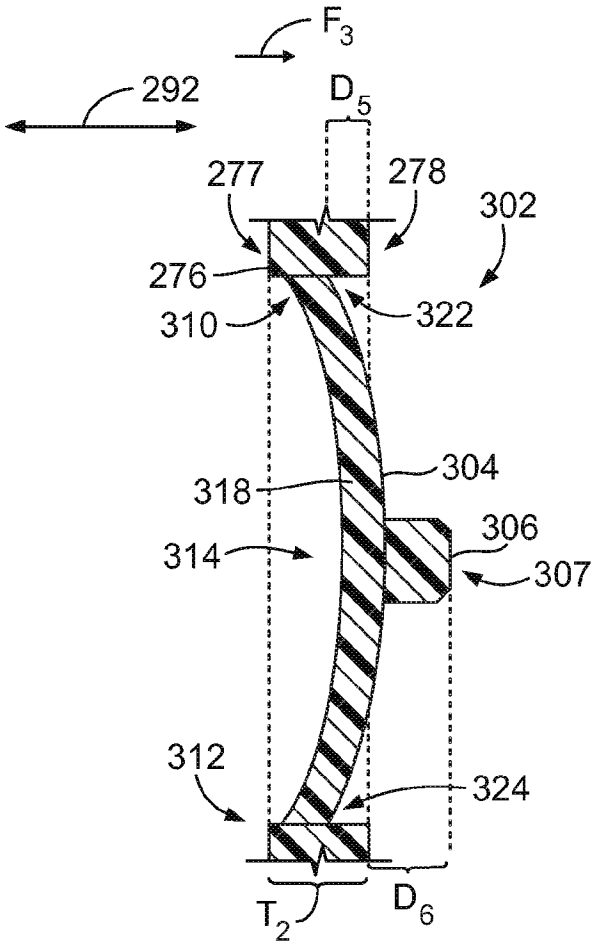
FIG. 4 is a cross-sectional view of a float-control member of the mating connector taken along the line 4-4 in FIG. 3.

FIGS. 4 and 5 illustrate the float-control member 302 in greater detail. FIG. 4 is a cross-sectional view of the float-control member 302 taken along the line 4-4 in FIG. 3, and FIG. 5 is an enlarged front view of the float-control member 302. In particular embodiments, the float-control member(s) 302 is integrally formed from the panel body 276. The float-control members 302 and the flange portion 236 may be formed from a common material. In some embodiments, the float-control members 302, the flange portion 236, and the header portion 234 may be formed from a common material. For example, the second connector 204 may be formed through a mold that is injected with a resin-type material that is cooled or cured into the shape of the float-control members 302, the flange portion 236, and the header portion 234.

However, in alternative embodiments, the float-control members 302 may be separate parts or features that couple to the flange portion 236 or panel body 276.

The float-control member 302 may include a flex element 304 and a protrusion 306 that is operatively coupled to the flex element 304. The flex element 304 is configured to flex back and forth within an aperture 315 of the panel body 276. More specifically, the flex element 304 may move back and forth in a direction along the longitudinal axis 292. The aperture 315 may be defined by edges or sidewalls 321-324 of the panel body 276. As shown in FIG. 5, the flex element 304 may be located within a thickness $T_2$ of the panel body 276 and defined by a pair of spaced apart slots 308 that extend through the thickness $T_2$ of the panel body 276. The slots 308 extend along a length of the flex element 304. As shown in FIG. 4, the flex element 304 has an arcuate body 318 that extends lengthwise between opposite end portions 310 and 312. In particular embodiments, the arcuate body 318 curves from a depth $D_5$ into the panel body 276 at one end portion 310 toward the mating side 278. The flex element 304 may clear the mating side 278 near a center portion 314. In alternative embodiments, the center portion 314 is substantially flush with the mating side 278 or, in other embodiments, the center portion 314 may be located a depth within the panel body 276. The protrusion 306 may be located proximate to the center portion 314 and include a distal tip 307. The protrusion may project an axial distance $D_6$ away from the mating side 278 along the longitudinal axis 292 to the distal tip 307. The protrusion 306 may extend beyond the mating side 278 (i.e., clear a plane that extends along the mating side 278) when the protrusion 306 is in a biased condition.

When the flex element 304 and the protrusion 306 of the float-control member 302 are in a biased condition as shown in FIG. 4, the flex element 304 provides a flex force $F_3$ that holds the protrusion 306 in an extended or projected position. The flex force $F_3$ resists movement of the protrusion 306 and flex element 304 into the panel body 276. Specifically, the float-control member 302 may resist movement of the protrusion 306 in an axial direction along the longitudinal axis 292 toward the loading side 277.

Figure 7A:
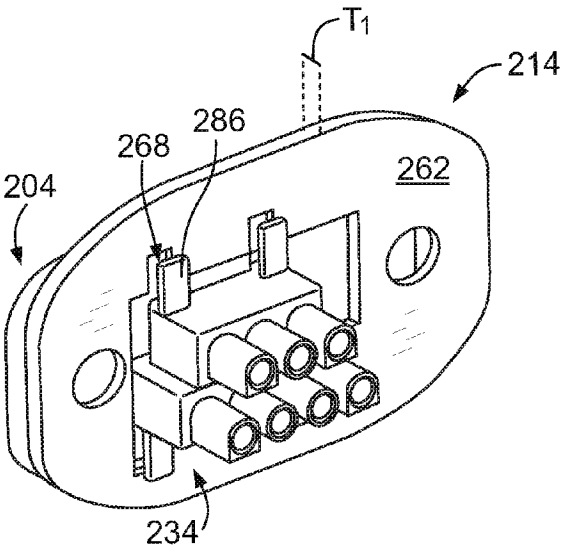
FIGS. 7A and 7B show different views of the mating connector interfacing with the mating connector.
Figure 7B:
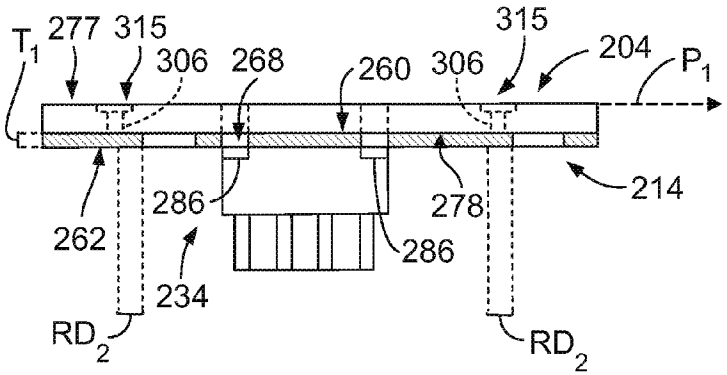
Figure 6A:
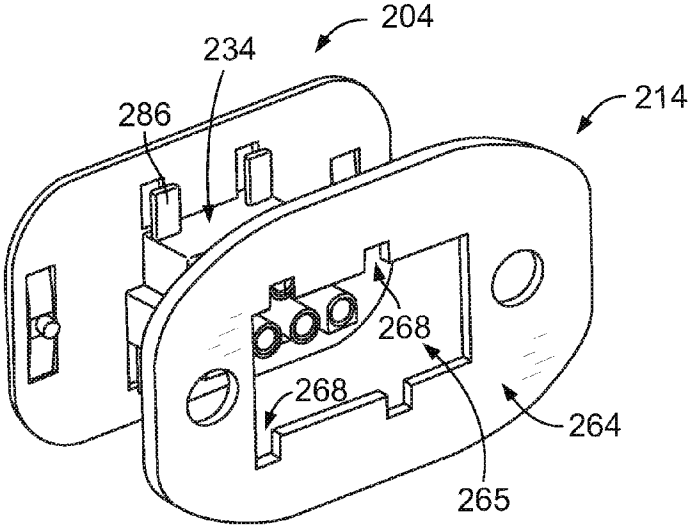
FIGS. 6A and 6B show different views of the mating connector approaching the support panel.
Figure 6B:
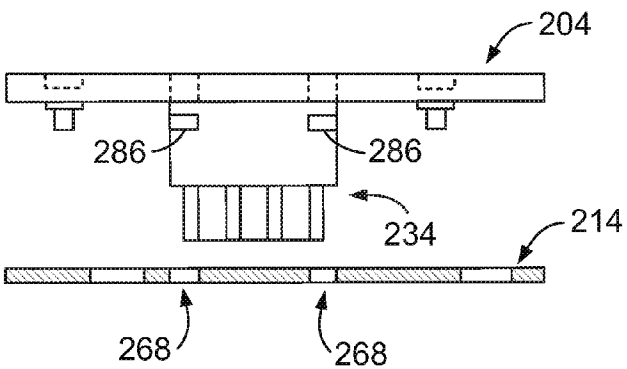
Figure 8C:
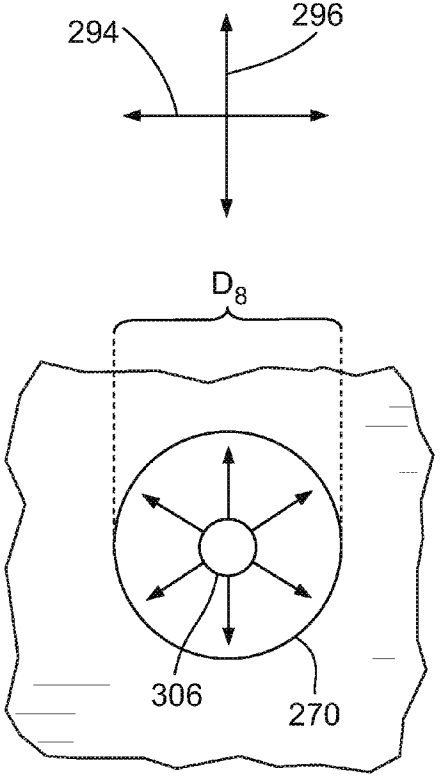
FIG. 8C is an enlarged plan view of a protrusion of the mating connector moving within a displacement opening of the support panel.
Figure 8A:
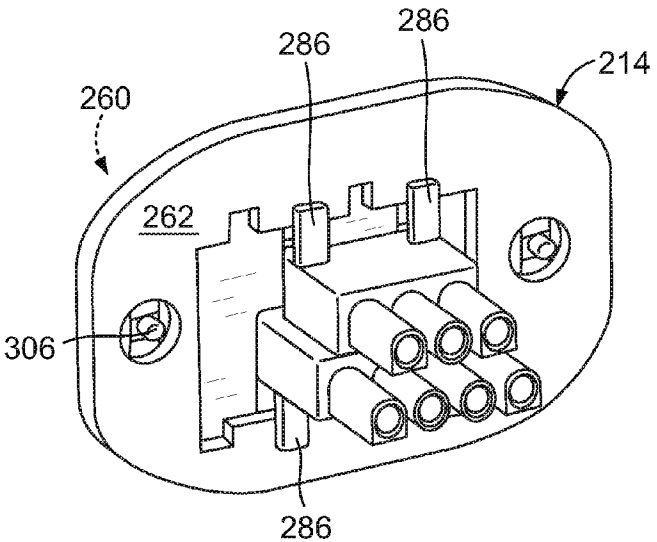
FIGS. 8A and 8B show different views of the mating connector in a slidably mounted position with the support panel.
Figure 8B:
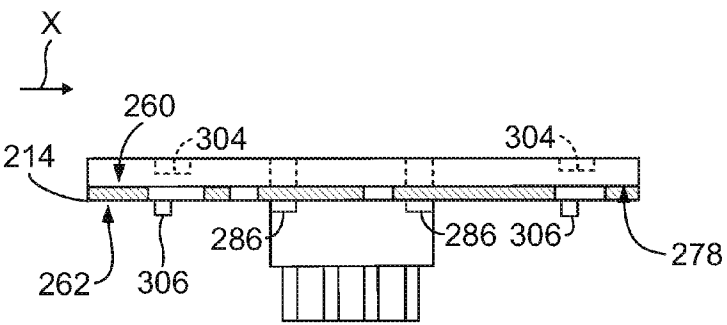

FIGS. 6-8 illustrate in greater detail a method of slidably mounting the second connector 204 to the support panel 214. FIGS. 6-8 each illustrate a perspective view of the second connector 204 and the support panel 214 during the mounting process (FIGS. 6A, 7A, and 8A) and also a top-down view of the second connector 204 and the support panel 214 (FIGS. 6B, 7B, 8B). As shown in FIGS. 6A and 6B, the second connector 204 and the support panel 214 are oriented to face each other. More specifically, the header portion 234 is positioned to advance through the main portion 265 of the mounting window 264 (FIG. 6A). The retaining tabs 286 are aligned with the cut-portions 268.

FIGS. 7A and 7B illustrate positional relationships of the second connector 204 and the support panel 214 relative to each other after the header portion 234 has advanced through the main portion 265 (FIG. 7A) and the retaining tabs 286 have advanced through the cut-out portions 268. The retaining tabs 286 and the mating side 278 are separated from each other by the axial distance $D_7$ (FIG. 3). The axial distance $D_7$ is configured to accommodate the thickness $T_1$ of the support panel 214 so that the retaining tabs 286 clear the exterior surface 262 as shown in FIGS. 7A and 7B when advanced therethrough. When the header portion 234 is advanced through the mounting window 264, the protrusions 306 (FIG. 7B) may engage the interior surface 260 of the support panel 214 and deflect toward the loading side 277 of the second connector 204 along the axial direction. As such, the flex element 304 and the protrusion 306 have a deflected condition as shown in FIG. 7B. In the illustrated embodiment, the protrusions 306 are deflected entirely within the corresponding apertures 315 such that distal tips 307 (FIG. 4) of the protrusions 306 are substantially flush with a surface plane $P_1$ of the mating side 278. As shown in FIG. 7B, each protrusion 306 may be separated from the corresponding displacement opening 270 by a radial distance $RD_2$.

FIGS. 8A and 8B illustrate the second connector 204 and the support panel 214 in the slidably mounted arrangement. When the retaining tabs 286 have cleared the exterior surface 262 of the support panel 214, the interior surface 260 of the support panel 214 and the mating side 278 of the second connector 204 may form a slidable interface such that interior surface 260 and the mating side 278 are capable of sliding alongside each other. As the second connector 204 slides in a radial direction (indicated by the arrow X) with respect to the longitudinal axis 292, the displacement openings 270 approach the corresponding float-control members 302. Each protrusion 306 springs back toward the biased condition when the protrusion 306 clears the corresponding displacement opening 270. The protrusions 306 may then be located within the corresponding displacement openings 270 when the second connector 204 and the support panel 214 are slidably mounted.

FIG. 8C illustrates the protrusion 306 moving within the displacement opening 270. The protrusion 306 and the corresponding opening 270 may be sized and shaped to control a range of movement of the second connector 204 (FIG. 3), which may define a confined spatial region that the second connector 204 is permitted to move within. For example, the displacement opening 270 is substantially circular. As such, the second connector 204 may freely move along the radial plane formed by the lateral and vertical axes 294 and 296 a distance $D_8$ that is substantially equal to the diameter of the displacement opening 270. However, the displacement opening 270 may have other sizes and shapes to control the range of movement of the second connector 204. In particular embodiments, the support panel 214 is confined between the retaining tabs 286 and the mating side 278 such that the mating connector 204 is only movable in a radial direction, which may include the second connector slightly rotating about the longitudinal axis 292 (FIG. 3). However, in alternative embodiments, the axial distance $D_7$ between the retaining tabs 286 and the surface plane $P_1$ (FIG. 7B) of the mating side 278 may provide a clearance that permits the second connector 204 to move slightly in the axial direction and/or rotate slightly about vertical axis 296. Although not shown, the range of movement of the second connector 204 may be at least partially defined by edges that define the mounting window 264.

Figure 9:
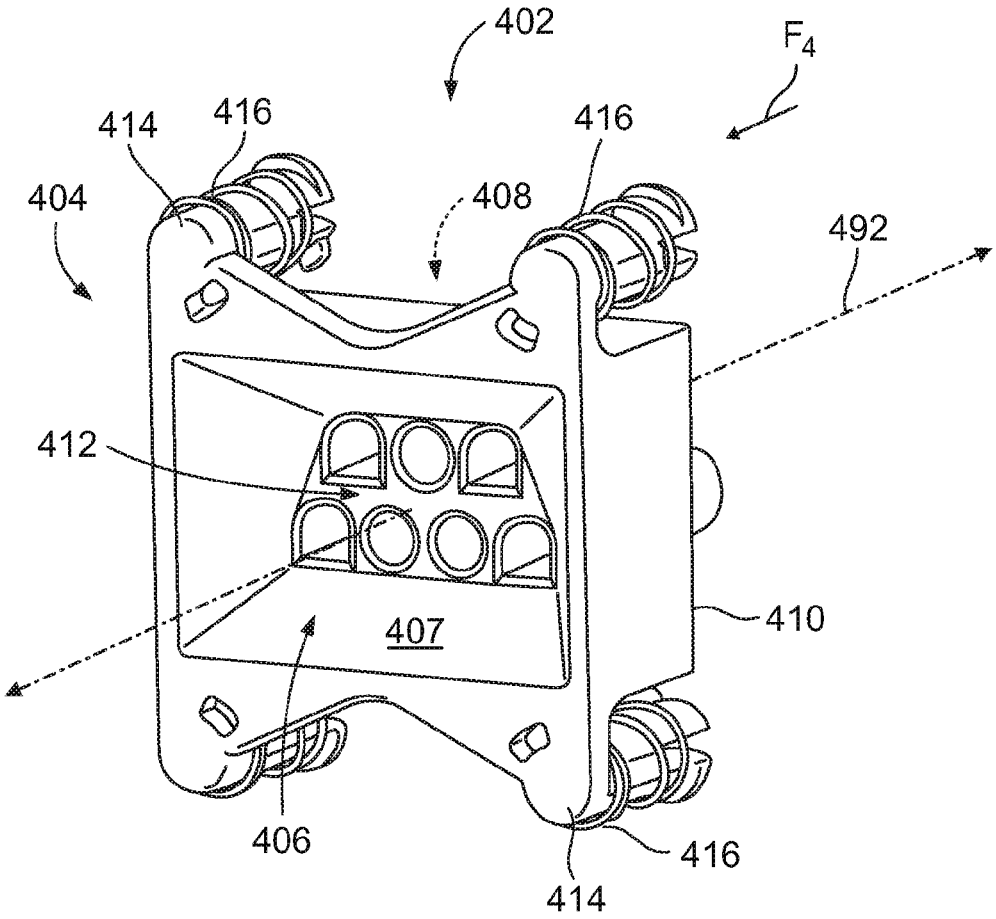
FIG. 9 is a perspective view of a base connector formed in accordance with one embodiment.

FIG. 9 is a perspective view of a first or base connector 402 formed in accordance with one embodiment. The first connector 402 may be similar to the first connector 102 described with reference to FIGS. 1 and 2. As shown, the first connector 402 is oriented with respect to an alignment axis 492. When the first and second connectors 402 and 204 are engaged, the alignment axis 492 and the longitudinal axis 292 are aligned with each other. The first connector 402 includes a connector body 410 having a mating and loading sides 404 and 409. The mating side 404 opens to an exterior space in a direction along the alignment axis 492. The mating side 404 is configured to engage the second connector 204. For example, the mating side 404 may include a guide recess 406 that is sized and shaped to receive the header portion 234 (FIG. 3) of the second connector 204. The guide recess 406 is shaped by a guiding surface 407 of the mating side 404. The guiding surface 407 may be configured to direct the second connector 204 toward a center (or toward the alignment axis 492) when the second connector 204 engages the guiding surface 407 in a misaligned manner with respect to the first connector 402.

In the illustrated embodiment, the connector body 410 is substantially rectangular or block-shaped. However, the connector body 410 may have other shapes as desired. As shown in FIG. 9, the guide recess 406 is configured to direct the second connector 204 toward terminal cavities 412 where mating terminals (not shown) are located. The mating terminals of the terminal cavities 412 are configured to electrically or optically connect with the mating terminals of the second connector 204.

Figure 11:
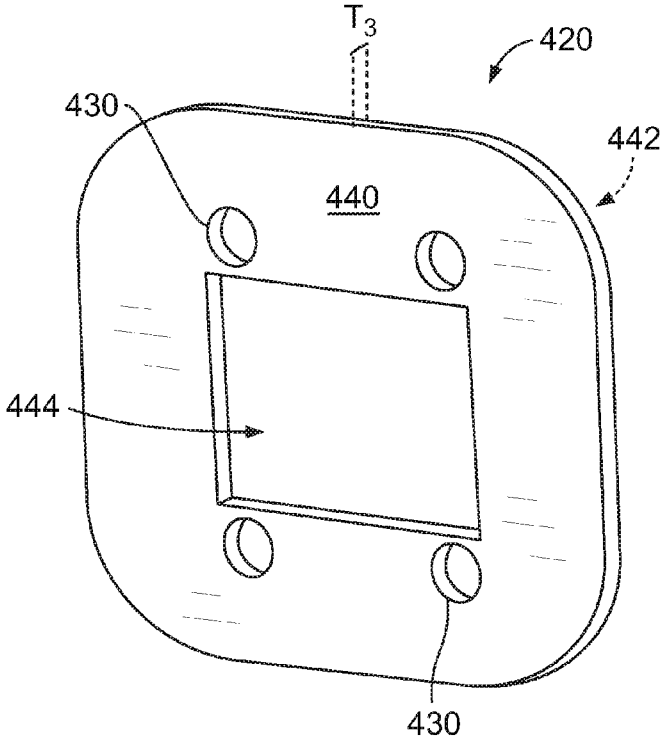
FIG. 11 is a perspective view of a support structure configured to engage the base connector of FIG. 9.

The first connector 402 may include one or more engagement posts 414 that are configured to engage and through a support structure 420 (shown in FIG. 11). In particular embodiments, the first connector 402 may include a plurality of engagement posts 414. For example, the first connector 402 may include at least three engagement posts 414 that are substantially distributed about the alignment axis 492. In the illustrated embodiment, the first connector 402 includes four engagement posts 414 that are substantially equally distributed about the alignment axis 492. The engagement posts 414 may be integrally formed (e.g., through an injection molding process) with connector body 410. In alternative embodiments, the engagement posts are separately coupled to the connector body 410.

In particular embodiments, each engagement post 414 includes a biasing member 416. The biasing members 416 provide a resilient force $F_4$ in a direction along the alignment axis 492 that is configured to hold the first connector 402 in a projected position. The biasing members 416 are illustrated as coil springs that are wrapped about the engagement posts 414 in FIG. 9. However, the biasing members 416 may be other elements or devices that provide the resilient force $F_4$. Furthermore, in alternative embodiments, the biasing members 416 may not be wrapped about or otherwise coupled to the engagement posts 414, but may be separate from the engagement posts 414. For example, a biasing member may be coupled to the loading side 409 and the support structure 420 (FIG. 11).

Figure 10:
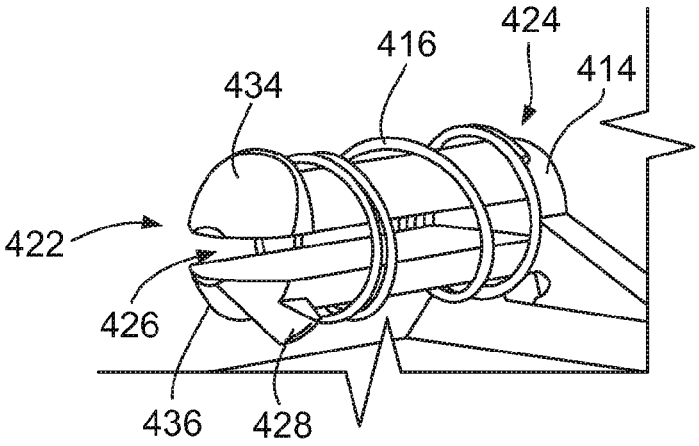
FIG. 10 is an enlarged perspective view of an engagement post of the base connector shown in FIG. 9.

FIG. 10 is an enlarged perspective view of one engagement post 414 and a corresponding biasing member 416. As shown, the engagement post 414 extends between an end 422 and a base 424 and has a longitudinal slit 426 extending substantially therebetween thereby forming two separate post elements 434 and 436. The longitudinal slit 426 permits the post elements 434 and 436 to be deflected toward each other when the engagement post 414 is inserted through a post opening 430 (shown in FIG. 11) of the support structure 420 (FIG. 11). To this end, the end 422 may be shaped to be inserted through the post opening 430 when the connector body 410 (FIG. 9) is coupled to the support structure 420. Also shown, the end 422 may include a locking feature 428 that projects radially away from a surface of the engagement post 414.

FIG. 11 is a perspective view of the support structure 420. The support structure 420 may be a portion of a wall or panel of a base component (not shown). The support structure 420 includes an exterior or front surface 440 and an interior surface 442 and a thickness $T_3$ extending therebetween. As shown, the support structure 420 has a plurality of openings including a mounting passage 444 and the post openings 430. The mounting passage 444 is sized and shaped to permit the connector body 410 to pass therethrough. The post openings 430 are sized and shaped to receive the engagement posts 414. In particular embodiments, the post openings 430 are sized for the post elements to 434 and 436 to clear and pass therethrough, but prevent the biasing members 416 from passing therethrough.

Figure 12:
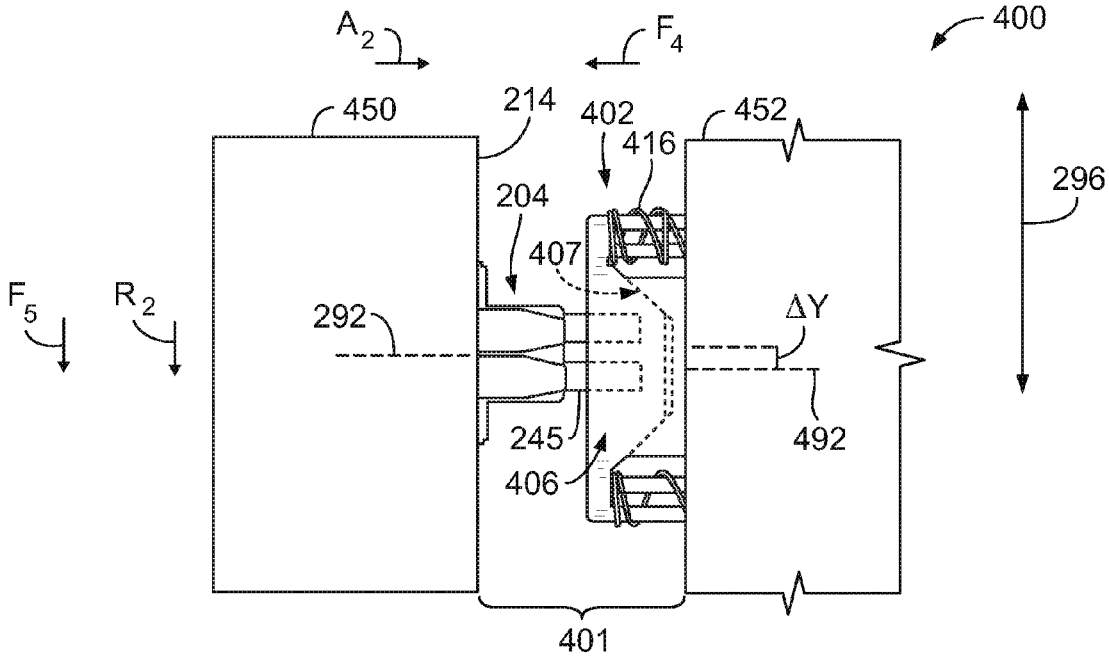
FIG. 12 is a side view of a connector system formed in accordance with one embodiment that includes the mating and base connectors.

FIG. 12 is a side view of a connector system 400. The connector system 400 includes a removable or modular component 450 and a base or support component 452. The connector system 400 also includes a connector assembly 401 that includes the first and second connectors 402 and 204. The modular component 450 includes the second connector 204, and the base component 452 includes the first connector 402. During a mating operation, the modular component 450 is oriented to face the base component 452. The modular component 450 is moved in an axial direction $A_2$ toward the base component 452 so that the second connector 204 may be received by the first connector 402. The modular component 450 includes the support panel 214 having the exterior surface 262, and the base component 452 includes the support structure 420 having the exterior surface 440.

FIG. 12 shows the first and second connectors 402 and 204 as the two connectors engage each other in a misaligned manner. For example, the longitudinal axis 292 of the second connector 204 may be a radial distance (indicated by $\Delta Y$) away from the alignment axis 492 along the vertical axis 296. When the terminal projections 245 advance into the guide recess 406 in a misaligned manner, the second connector 204 may engage the guiding surface 407. For example, at least one of the terminal projections 245 shown in FIG. 12 may engage the guiding surface 407. The first connector 402 is held in a projected position as shown in FIG. 12 by the resilient force $F_4$ caused by the biasing members 416. When the terminal projections 245 engage the guiding surface 407, the guiding surface 407, supported by the resilient force $F_4$, may cause the second connector 204 to shift in the radial direction $R_2$ to align the first and second connectors 402 and 204 and, more specifically, the corresponding mating terminals (not shown). More specifically, the radial forces $F_5$ that redirect the second connector 204 may be greater than frictional forces generated between the surfaces of the second connector and the surfaces of the support panel 214. The second connector 204 moves parallel to the exterior surface 262 in the radial direction. The guiding surface 407 directs the terminal projections 245 into the corresponding terminal cavities 412 so that the respective mating terminals may engage each other.

Figure 14:
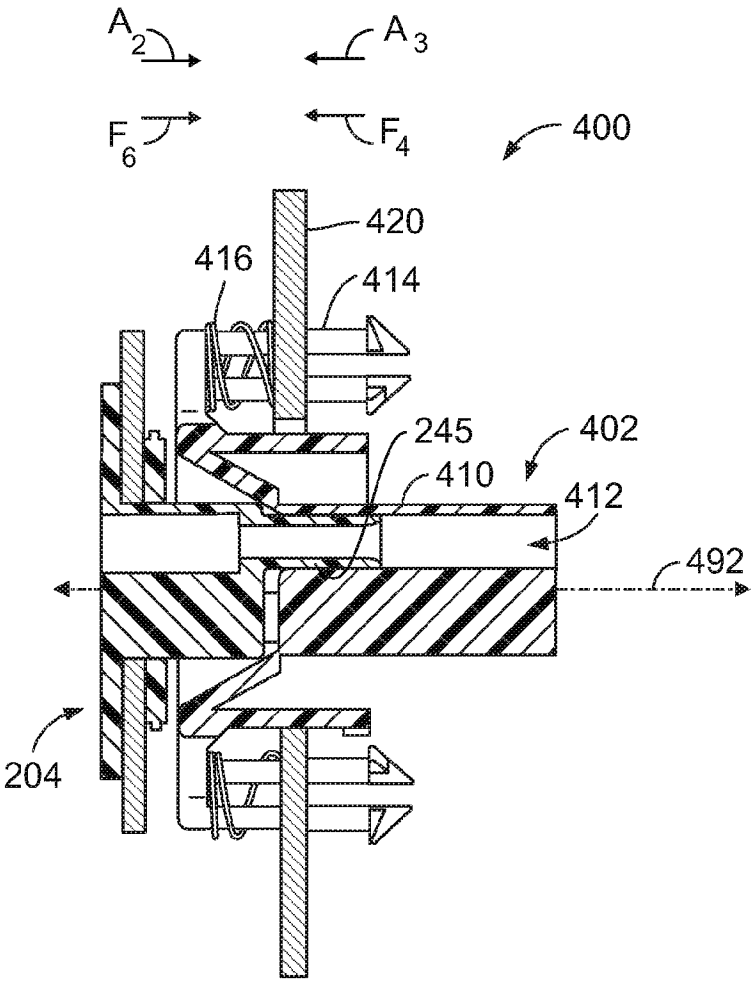
FIG. 14 is a cross-sectional side view of the connector system of FIG. 12 in which the base connector is in a retracted position.
Figure 13:
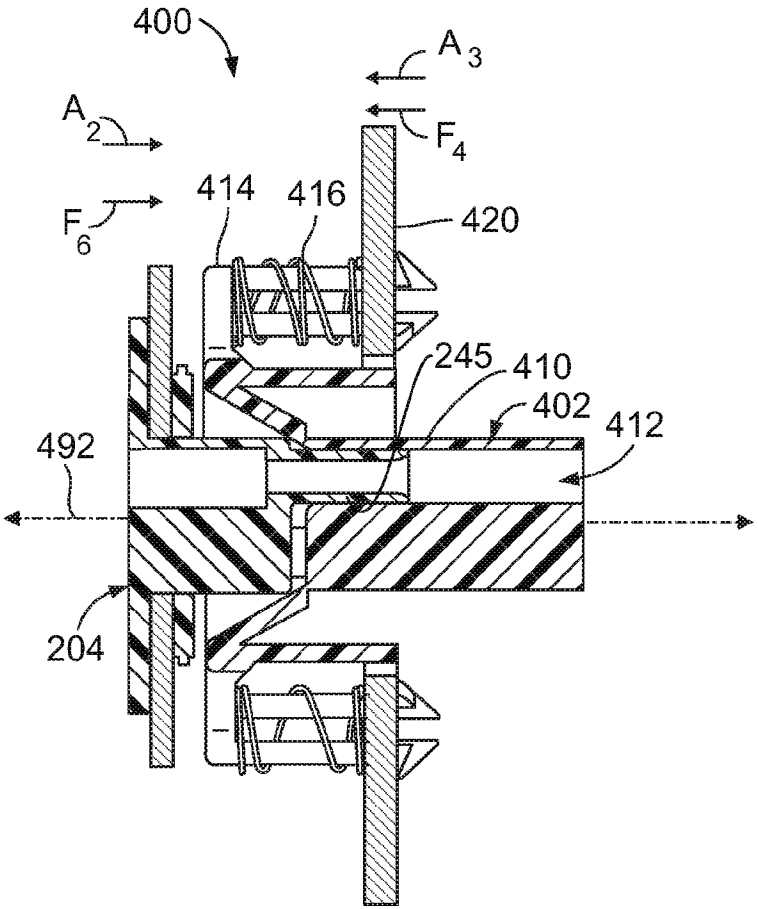
FIG. 13 is a cross-sectional side view of the connector system of FIG. 12 in which the base connector is in a projected position.

FIGS. 13 and 14 are cross-sectional views of the connector system 400 after the first and second connectors 402 and 204 are properly aligned with each other and the terminal projections 245 have advanced into the terminal cavities 412. A mating force $F_6$ may be applied to the second connector 204 in the axial direction $A_2$ thereby moving the terminal projections 245 into the corresponding terminal cavities 412. The terminal projections 245 and the terminal cavities 412 may be configured with respect to each other to form an interference fit. For example, the terminal, projections 245 and the terminal cavities 412 may have similar cross-sectional shapes. As the terminal projections 245 are inserted further into the corresponding terminal cavities 412, frictional forces generated between the surfaces of the terminal projections 245 and the terminal cavities 412 may increase. The frictional forces of the interference fit may be configured to retain or hold the second connector 204 in the communicatively engaged position so that the first and second connectors 402 and 204 are not inadvertently disengaged. In some embodiment's, the first and second connectors 402 and 204 remain communicatively engaged with each other exclusively through frictional forces generated by the interference fit.

During the mating operation, the terminal projections 245 may be fully inserted into the corresponding terminal cavities 412. If the mating force $F_6$ continues to be applied and the mating force $F_6$ exceeds the resilient force $F_4$, the first connector 402 may be moved along the alignment axis 492 from the projected position shown in FIG. 13 to a retracted position shown in FIG. 14. As shown, the first connector 402 moves with respect to the support structure 420. More specifically, the first connector 402 moves toward and away from the exterior surface 440. The connector body 410 may move through the passage 444 (FIG. 11) and the engagement posts 414 may move through the corresponding post openings 430 (FIG. 11). The engagement posts 414, the post openings 430, the biasing members 416, and the passage 444 may be configured such that the first connector 402 is only movable in the axial direction $A_2$. However, in such embodiments, it is understood that tolerances from manufacturing processes may permit slight rotation or movement on other axes. In alternative embodiments, the first connector 402 is permitted to move in other directions in addition to the axial direction $A_2$.

During some mating operations, the resilient forces $F_4$ may provide a tactile indication to an operator or technician that the first and second connectors 402 and 204 are communicatively engaged. For example, after the first and second connectors 402 and 204 are aligned and engaged, the resilient force $F_4$ resist movement of the first connector 402 in the axial direction $A_2$. A technician may notice a difference in resistance and, thus, remove the mating force $F_6$. As such, the first connector 402 may reduce a likelihood of the first or second connectors 402 and 204 being damaged from excessive forces applied during a mating operation. Furthermore, the first connector 402 may also yield to the mating force $F_6$ (i.e. by moving from the projected position to a retracted position) if the first and second connectors are misaligned and the resulting axial force pushing on the first connector 402 exceeds the resilient force $F_4$. As such, the first connector 402 may reduce a likelihood of the first or second connectors 402 and 204 being damaged from excessive forces applied during a mating operation when the connectors are misaligned.

Accordingly, in some embodiments, the second connector 204 shifts in the radial direction $R_2$ (FIG. 12) and is aligned with the first connector 402 before the first connector 402 move in the axial direction $A_2$. However, in alternative embodiments, the first connector 402 may be configured to allow movement in the axial direction before the first and second connectors 402 and 204 are aligned. For example, if the first and second connectors 402 and 204 are misaligned and the resulting axial force pushing on the first connector 402 exceeds the resilient force $F_4$, the first connector 402 may move in the axial direction.

After the first and second connectors 402 and 204 are communicatively engaged, the mating force $F_6$ may be reduced or removed. In such cases, the resilient forces $F_4$ generated by the compressed biasing members 416 may cause the first connector 402 to be moved along an axial direction $A_3$ toward the projected position shown in FIG. 13. As shown, the axial direction $A_3$ is opposite to the axial direction $A_2$.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first." "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a first connector configured to be movably mounted to a support structure and having a first mating terminal, the first connector being movable with respect to the support structure in an axial direction along an alignment axis; and a second connector configured to be movably mounted to a support panel and having a second mating terminal, the second connector being movable with respect to the support panel in a radial direction relative to an alignment axis;

wherein the second connector shifts in the radial direction to align the first and second mating terminals when the first and second connectors engage each other in a misaligned manner, and wherein the first connector moves between a projected position and a retracted position along the alignment axis to facilitate establishing a communication pathway between the first and second mating terminals.

2. The connector assembly in accordance with claim 1, wherein the first connector has a guide recess that receives the second connector, the guide recess comprising a guiding surface that engages the second connector and redirects the second connector when the second connector approaches the first connector in the misaligned manner.

3. The connector assembly in accordance with claim 1, wherein the first connector is biased in the projected position such that the first connector resists movement in an axial direction away from the projected position.

4. The connector assembly in accordance with claim 1, wherein the second connector shifts in the radial direction before the first connector moves in the axial direction.

5. The connector assembly in accordance with claim 1, wherein the first and second connectors form an interference fit when communicatively engaged with each other, the first and second connectors remaining communicatively engaged with each other exclusively through frictional forces generated by the interference fit.

6. The connector assembly in accordance with claim 1 further comprising a plurality of biasing members, the biasing members providing a resilient force to resist movement of the first connector in the axial direction away from the projected position.

7. The connector assembly in accordance with claim 1, wherein the first connector includes a plurality of engagement posts that couple to the support structure, the engagement posts being movable into and out of the support structure in the axial direction.

8. The connector assembly in accordance with claim 7, further comprising biasing members having coil springs that are wrapped about the engagement posts, the coil springs providing a resilient force to resist movement of the first connector in the axial direction away from the projected position.

9. The connector assembly in accordance with claim 1, wherein the second connector includes a float-control member that is configured for insertion into a displacement opening of the support panel, the float-control member moving within the displacement opening to permit the header portion to slide along the support panel.

10. The connector assembly in accordance with claim 9, wherein the float-control member includes a protrusion and a flex element that supports the protrusion in a biased condition when unengaged, the flex element being configured to move away from the biased condition to a deflected condition when the protrusion is pressed against the support panel.

11. The connector assembly in accordance with claim 1, wherein the first connector is only movable in the axial direction.

12. The connector assembly in accordance with claim 1, wherein the second connector is only movable in the radial direction.

13. The connector assembly in accordance with claim 1, wherein the radial direction is parallel to the support panel and the axial direction is perpendicular to the support panel.

14. The connector assembly in accordance with claim 1, wherein the axial direction is perpendicular to the radial direction.

15. The connector assembly in accordance with claim 1, wherein the first and second connectors cooperate to accommodate misalignment in three dimensions.

16. A connector system comprising:

a modular component having a support structure with a front surface and a first connector that is configured to be movably mounted to the support structure, the first connector being movable toward and away from the front surface of the support structure in an axial direction; and a base component having a support panel with a front surface and a second connector that is configured to be movably mounted to the support panel, the second connector being movable along the support panel in a radial direction that is parallel to the front surface of the support panel;

wherein the modular and base components are configured to removably engage each other through a mating operation, the second connector shilling in the radial direction during the mating operation when the first and second connectors are misaligned by a radial distance, the first connector moving in the axial direction during the mating operation.

17. The connector system in accordance with claim 16, wherein the front surface of the support structure is substantially parallel to the front surface of the support panel.

18. The connector system in accordance with claim 16, wherein the first connector has a guide recess that receives the second connector, the guide recess comprising a guiding surface that engages the second connector and redirects the second connector when the second connector approaches the first connector in the misaligned manner.

19. The connector system in accordance with claim 16, wherein the first connector is biased in the projected position such that the first connector resists movement in an axial direction away from the projected position.

20. The connector system in accordance with claim 16, wherein the second connector shifts in the radial direction before the first connector moves in the axial direction.

* * * * *